US007301500B1

(12) United States Patent
Sanford et al.

(10) Patent No.: US 7,301,500 B1
(45) Date of Patent: Nov. 27, 2007

(54) OFFSET QUASI-TWIN LEAD ANTENNA

(75) Inventors: John Sanford, Encinitas, CA (US); Anders Jensen, San Marcos, CA (US)

(73) Assignee: Cushcraft Corporation, Manchester, NH (US)

( * ) Notice: Subject to any disclaimer, the term of this patent is extended or adjusted under 35 U.S.C. 154(b) by 0 days.

(21) Appl. No.: 11/627,068

(22) Filed: Jan. 25, 2007

(51) Int. Cl.
*H01Q 1/38* (2006.01)

(52) U.S. Cl. ..... 343/700 MS; 343/795

(58) Field of Classification Search ..... 343/700 MS, 343/702, 795, 819, 840
See application file for complete search history.

(56) References Cited

U.S. PATENT DOCUMENTS 2,657,313 A * 10/1953 Antony ..... 343/742
2,880,416 A * 3/1959 Munzig ..... 343/720
3,439,310 A * 4/1969 Ryder ..... 439/221
3,611,198 A * 10/1971 Ma ..... 333/132
6,529,170 B1 * 3/2003 Nishizawa et al. ..... 343/795
7,098,863 B2 * 8/2006 Bancroft ..... 343/859

* cited by examiner

*Primary Examiner*—Tho Phan
(74) *Attorney, Agent, or Firm*—Harness, Dickey & Pierce, P.L.C.

(57) ABSTRACT

The quasi-twin lead line includes a dielectric substrate having a first side and an opposite side. A top conductor trace is integral with the first side of the dielectric substrate. The top conductor trace has a top conductor axis, a top conductor length, and a top conductor width, wherein the top conductor width is substantially uniform along the top conductor length. An opposite trace is integral with the opposite side of the dielectric substrate. The opposite trace has an opposite length and an opposite width substantially congruent to the top conductor length and the top conductor width. The opposite trace also has an opposite axis substantially parallel to the top conductor axis, wherein a plane containing both the top conductor axis and the opposite axis is oblique relative to the dielectric substrate.

11 Claims, 9 Drawing Sheets

IMPEDANCE VS. WIDTH

IMPEDANCE VS. OFFSET

OFFSET QUASI-TWIN LEAD ANTENNA

FIELD OF THE INVENTION

The present invention is generally related to antennas, and more particularly is related to an improvement on the twin lead antenna.

BACKGROUND OF THE INVENTION

Printed circuits are widely used. Printed circuits typically are broadband in frequency and provide circuits that are compact and light. They are economical to produce and are common to many antenna applications. There are many different transmission lines generally used for microwave integrated circuits.

FIG. 1 is a cross-sectional diagram of a microstrip line 10, as is known in the prior art. The microstrip line 10 is a transmission line geometry with a single conductor trace 12 on one side of a dielectric substrate 14 and a single ground plane on the opposite side 16. Electromagnetic field lines 18 represent the electromagnetic field exists partly in the air above the dielectric substrate 14 and partly within the dielectric substrate 14 itself. Since it is an open structure, the microstrip line has a major fabrication advantage over stripline transmission lines or other transmission lines having a closed structure.

Microstrip lines typically have a characteristic line impedance range of 20 to 120 Ohms, which is calculated based on the width W of the single conductor trace 12 and the height H of the dielectric substrate 14 relative to the dielectric constant of the substrate material. FIG. 2 is a graph showing characteristic line impedance ranges for a range of W/H values and a range of dielectric constants. Often, multiple transmission lines need to be designed on a single dielectric substrate 14, which often means selecting a single substrate height with a specific dielectric constant for all transmission line needs. For matching purposes and other considerations, it is necessary and/or desirable to construct transmission lines having varying impedances on the selected single dielectric substrate. Therefore, the range of available characteristic line impedances is useful for flexibility in designing the transmission lines.

FIG. 3 is a cross-sectional diagram of a twin lead line 110, as is known in the prior art. The twin lead line 110 is a transmission line geometry with a top conductor trace 112 on one side of a dielectric substrate 114 and a bottom conductor trace 116 on the opposite side. The bottom conductor trace 116 has a width W similar to the width W of the top conductor trace 112. Electromagnetic field lines 118 represent the electromagnetic field exists partly in the air above the dielectric substrate 114 and partly within the dielectric substrate 114 itself. The twin lead line 110 is an open structure, similar to the microstrip line 10.

Twin lead lines 110 typically have a characteristic line impedance range of 40 to 100 Ohms, which is calculated based on the common width W of the single conductor trace 112 and the bottom conductor trace 116 and the height H of the dielectric substrate 114 relative to the dielectric constant of the substrate material. FIG. 4 is a graph showing characteristic line impedance ranges for a range of W/H values and an $FR_4$ substrate. In antenna applications a twin lead line 110 may be desirable over a microstrip line 10 because it provides a balanced transmission line that is useful for feeding dipole elements. However, a drawback to the twin lead line 110 is a limited range of characteristic line impedances available for a single substrate thickness. As mentioned herein, a wide range of available characteristic line impedances is useful for flexibility in designing the transmission lines.

Twin leads may similarly be used for transmission line filters. Transmission line filters operate using impedance matching, as is known to those with ordinary skill in the art. Thus, having a wide range of available characteristic line impedances would be useful for flexibility in designing a transmission line filter.

Thus, a heretofore unaddressed need exists in the industry to address the aforementioned deficiencies and inadequacies.

SUMMARY OF THE INVENTION

Embodiments of the present invention provide a system and method for providing an offset quasi-twin lead antenna. Briefly described, in architecture, one embodiment of the system, among others, can be implemented as follows. The quasi-twin lead line includes a dielectric substrate having a first side and an opposite side. A top conductor trace is integral with the first side of the dielectric substrate. The top conductor trace has a top conductor axis, a top conductor length, and a top conductor width, wherein the top conductor width is substantially uniform along the top conductor length. An opposite trace is integral with the opposite side of the dielectric substrate. The opposite trace has an opposite length and an opposite width substantially congruent to the top conductor length and the top conductor width. The opposite trace also has an opposite axis substantially parallel to the top conductor axis, wherein a plane containing both the top conductor axis and the opposite axis is oblique relative to the dielectric substrate.

The present invention can also be viewed as providing methods for providing an offset quasi-twin lead antenna. In this regard, one embodiment of such a method, among others, can be broadly summarized by the following steps: providing a dielectric substance having a first side and an opposite side; applying a top conductor trace on the first side of the dielectric substrate, the top conductor trace having a top conductor axis, a top conductor length, and a top conductor width, wherein the top conductor width is substantially uniform along the top conductor length; and applying an opposite trace on the opposite side of the dielectric substrate, the opposite trace having an opposite length and an opposite width substantially congruent to the top conductor length and the top conductor width, the opposite trace further having an opposite axis substantially parallel to the top conductor axis, wherein a plane containing both the top conductor axis and the opposite axis is oblique relative to the dielectric substrate.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 5:
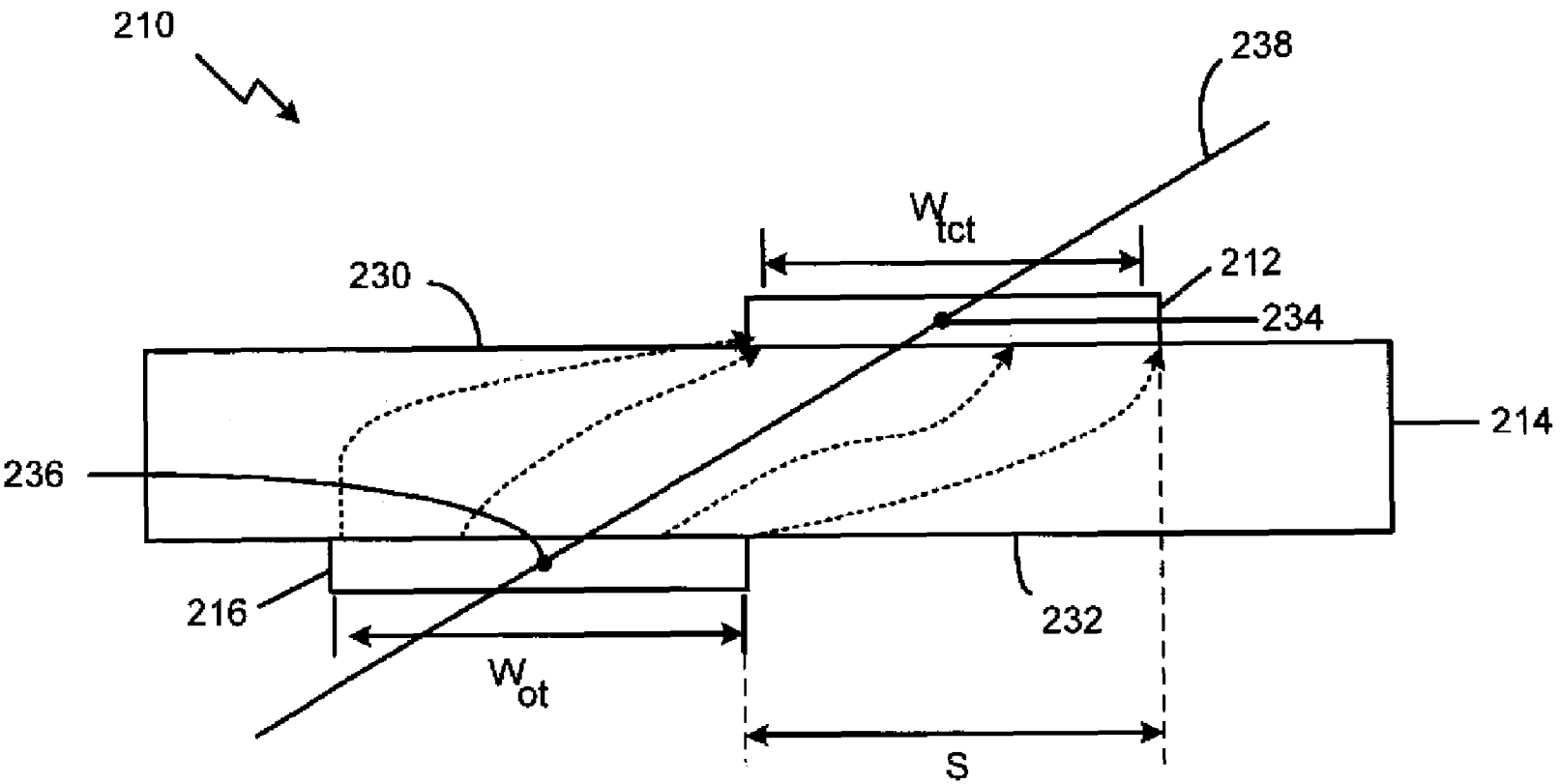
FIG. 5 is a cross-sectional diagram of a quasi-twin lead line, in accordance with a first exemplary embodiment of the present invention.

FIG. 5 is a cross-sectional diagram of a quasi-twin lead line 210, in accordance with a first exemplary embodiment of the present invention. The quasi-twin lead line 210 includes a dielectric substrate 214 having a first side 230 and an opposite side 232. A top conductor trace 212 is integral with the first side 230 of the dielectric substrate 214. The top conductor trace 212 has a top conductor axis 234, a top conductor length (not shown), and a top conductor width $W_{tct}$, wherein the top conductor width $W_{tct}$ is substantially uniform along the top conductor length. An opposite trace 216 is integral with the opposite side 232 of the dielectric substrate 214. The opposite trace 216 has an opposite length (not shown) and an opposite width $W_{ot}$ substantially congruent to the top conductor length and the top conductor width $W_{tct}$. The opposite trace 216 also has an opposite axis 236 substantially parallel to the top conductor axis 234, wherein a plane 238 containing both the top conductor axis 234 and the opposite axis 236 is oblique relative to the dielectric substrate 214.

Figure 1:
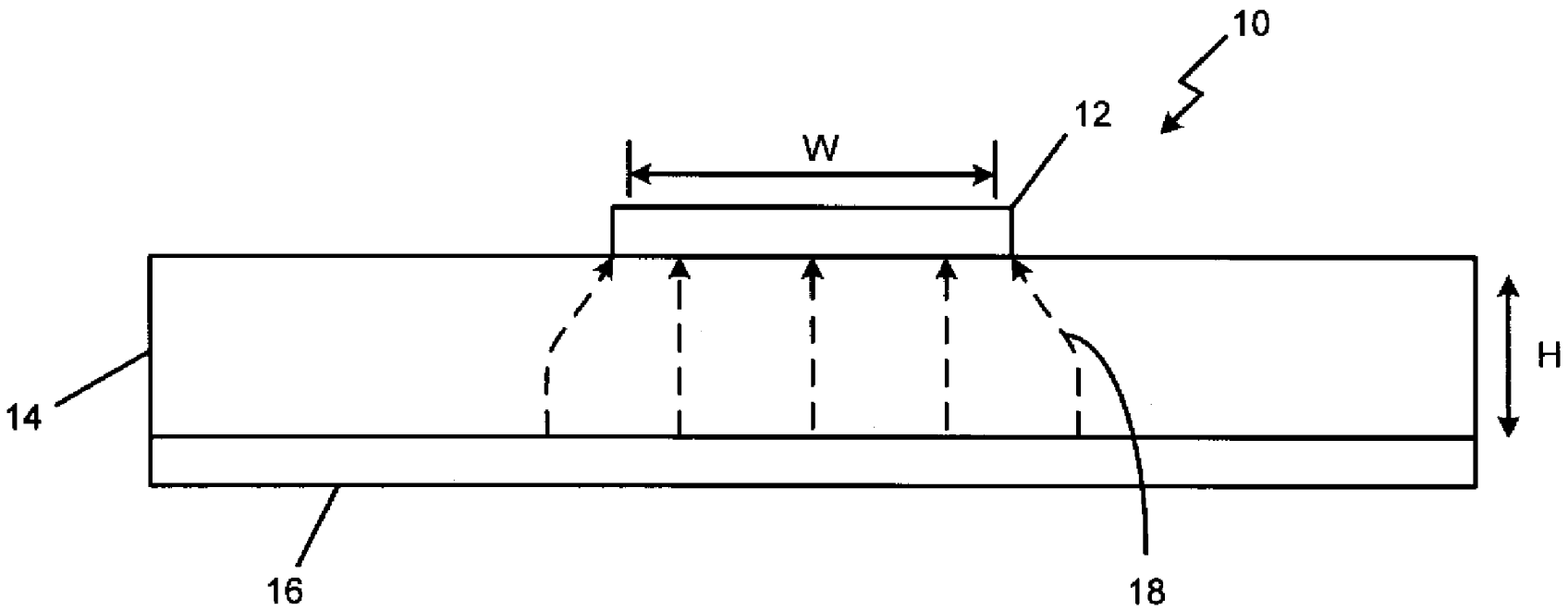
FIG. 1 PRIOR ART
FIG. 1 is a cross-sectional diagram of a microstrip line, as is known in the prior art.
Figure 2:
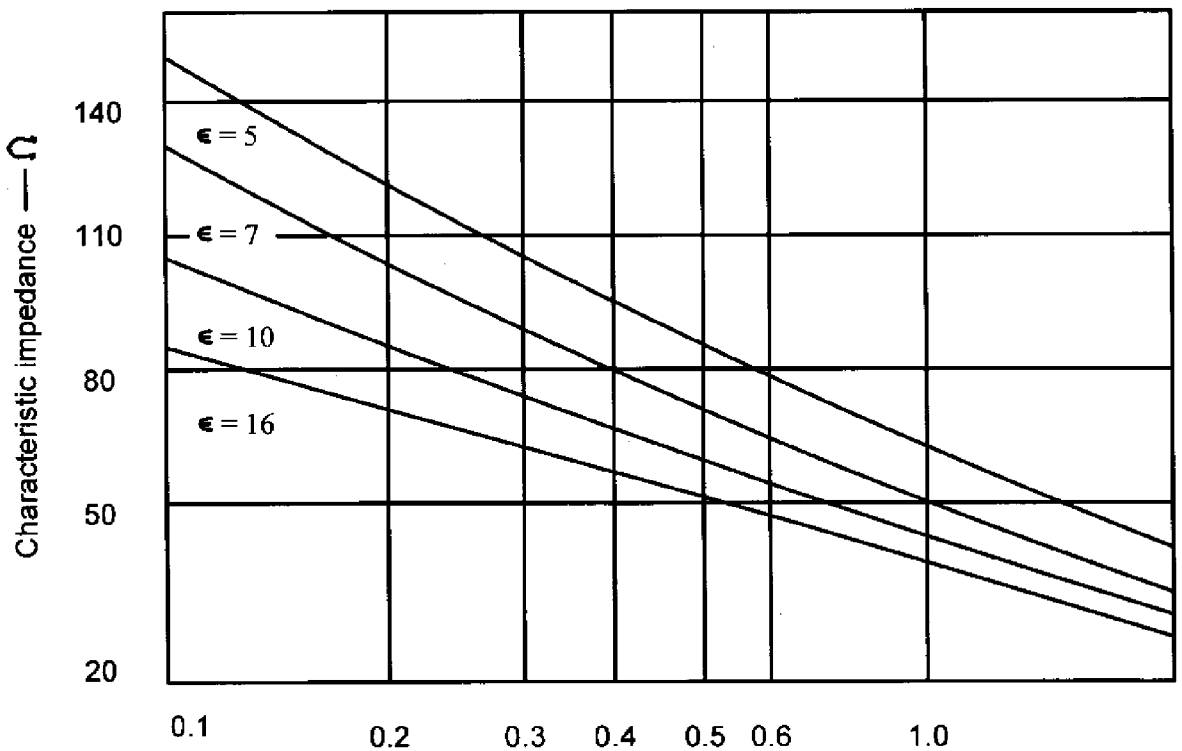
FIG. 2 PRIOR ART
FIG. 2 is a graph showing characteristic line impedance ranges for a range of W/H values and a range of dielectric constants for the microstrip line of FIG. 1.
Figure 3:
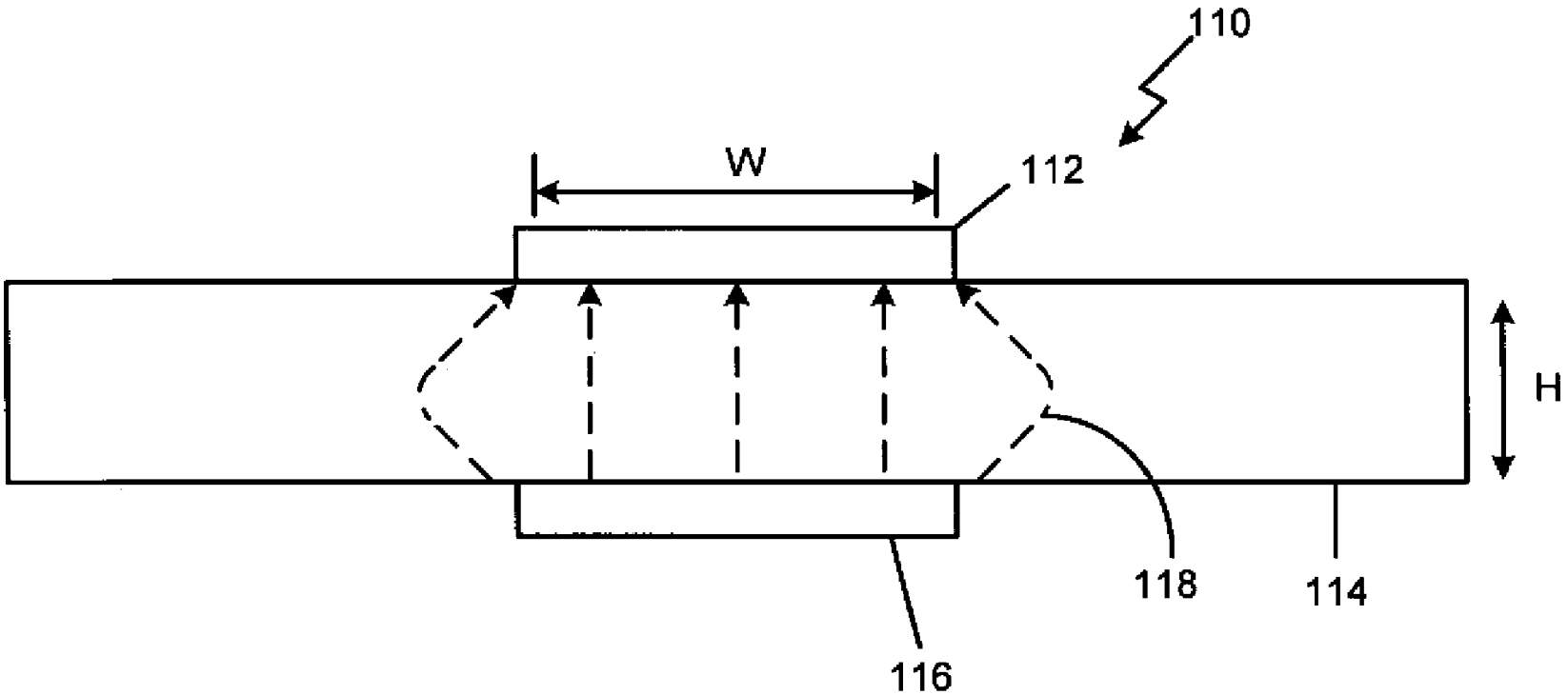
FIG. 3 PRIOR ART
FIG. 3 is a cross-sectional diagram of a twin lead line, as is known in the prior art.
Figure 4:
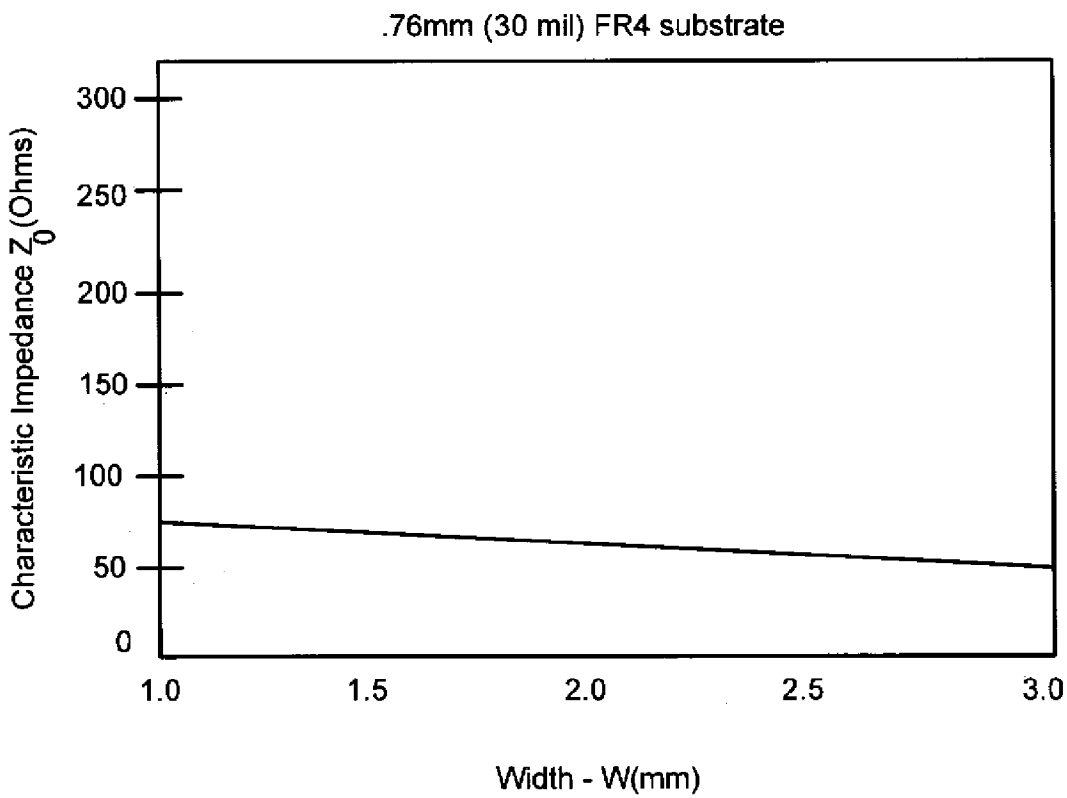
FIG. 4 is a graph showing characteristic line impedance ranges for a range of W/H values and a range of dielectric constants for the twin lead line of FIG. 3.

A difference between the quasi-twin lead line 210 in FIG. 5 and the twin lead line 110 of FIG. 3 is that the twin traces are relatively offset by a distance S in FIG. 5. Offsetting the twin traces varies the characteristic line impedance relative to the distance S. Electromagnetic field lines 218 represent the electromagnetic field that exists within the dielectric substrate 214. As can be readily discerned comparing FIG. 5, to FIG. 3, the greater the offset, the longer the electromagnetic field lines 218. And the longer the electromagnetic field lines 218, the greater the characteristic line impedance.

Figure 6:
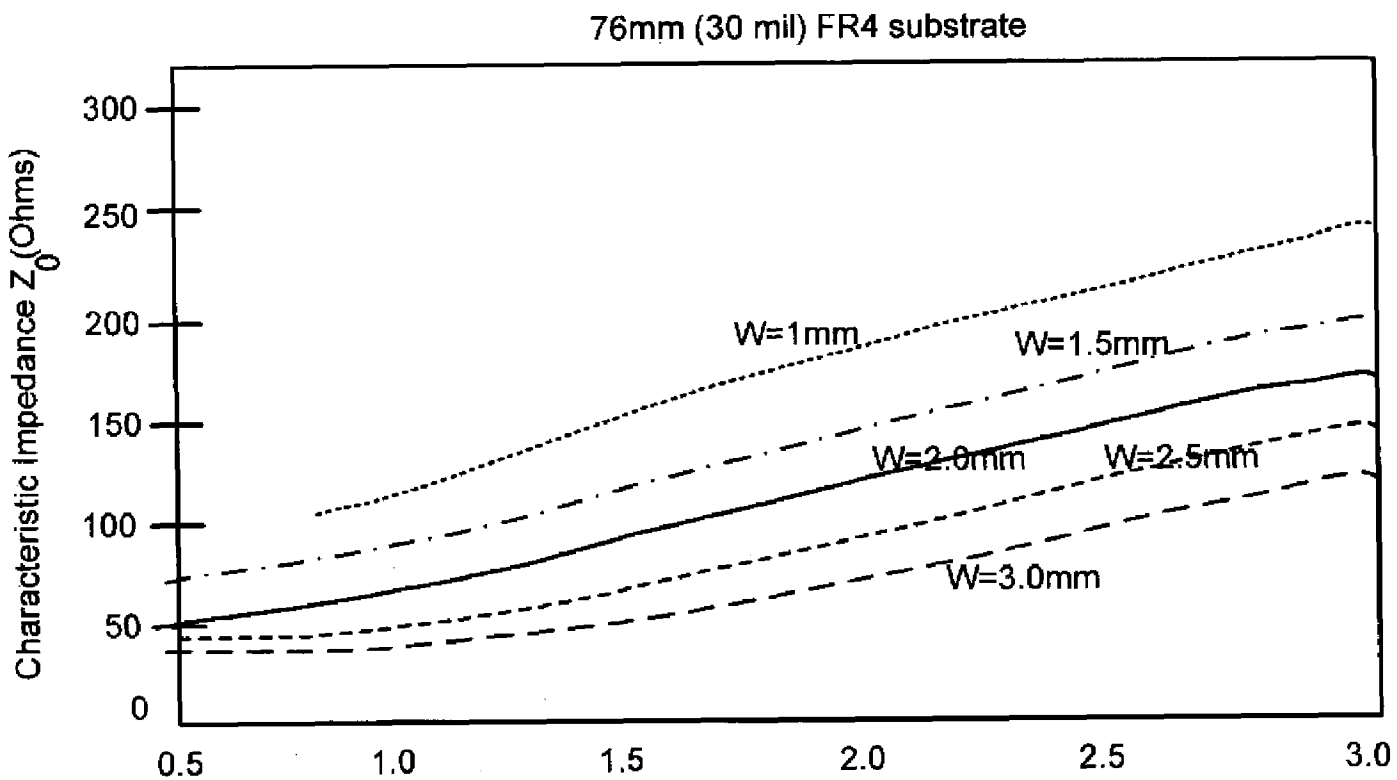
FIG. 6 is a graph showing characteristic line impedance ranges for a range of W/H values and a range of dielectric constants for the quasi-twin lead line of FIG. 5, in accordance with the first exemplary embodiment of the present invention.

FIG. 6 is a graph showing characteristic line impedance ranges for a range of W/H values and a range of dielectric constants for the quasi-twin lead line 210 of FIG. 5, in accordance with the first exemplary embodiment of the present invention. The graph of FIG. 6 has been limited to an $FR_4$ substrate that is 0.76 mm, although other dielectric materials and thicknesses may be utilized without departing from the scope of the present invention. As shown in the graph, characteristic line impedance can vary from 40-200 ohms simply by manipulating the top conductor width $W_{tct}$ and the opposite width $W_{ot}$ between 1.0 mm and 3.0 mm and by manipulating the offset distance S between 0.5 mm and 3.0 mm. These width and offset ranges are exemplary and provided for the purpose of the graph. A minimum width and maximum width are determined more by power limitations and acceptable size variances than by design limitations. Values outside these ranges are considered to be within the scope of the present invention.

The quasi-twin lead line 210 may be used to transmit signals, to receive signals, and/or to filter signals. There are occasions when it is appropriate to use a filter designed to provide bandpass matching to a lower or higher impedance. This technique permits tailoring of the passband so that the best possible match is obtained, subject to the limitations of the Bode-Fano limit. The use of impedance matching and/or utilization of varying impedances with twin lead lines is well known to those having ordinary skill in the art. Thus, one skilled in the art will understand how to take the quasi-twin lead line 210 disclosed herein to transmit/receive signals and/or to filter signals.

Figure 7:
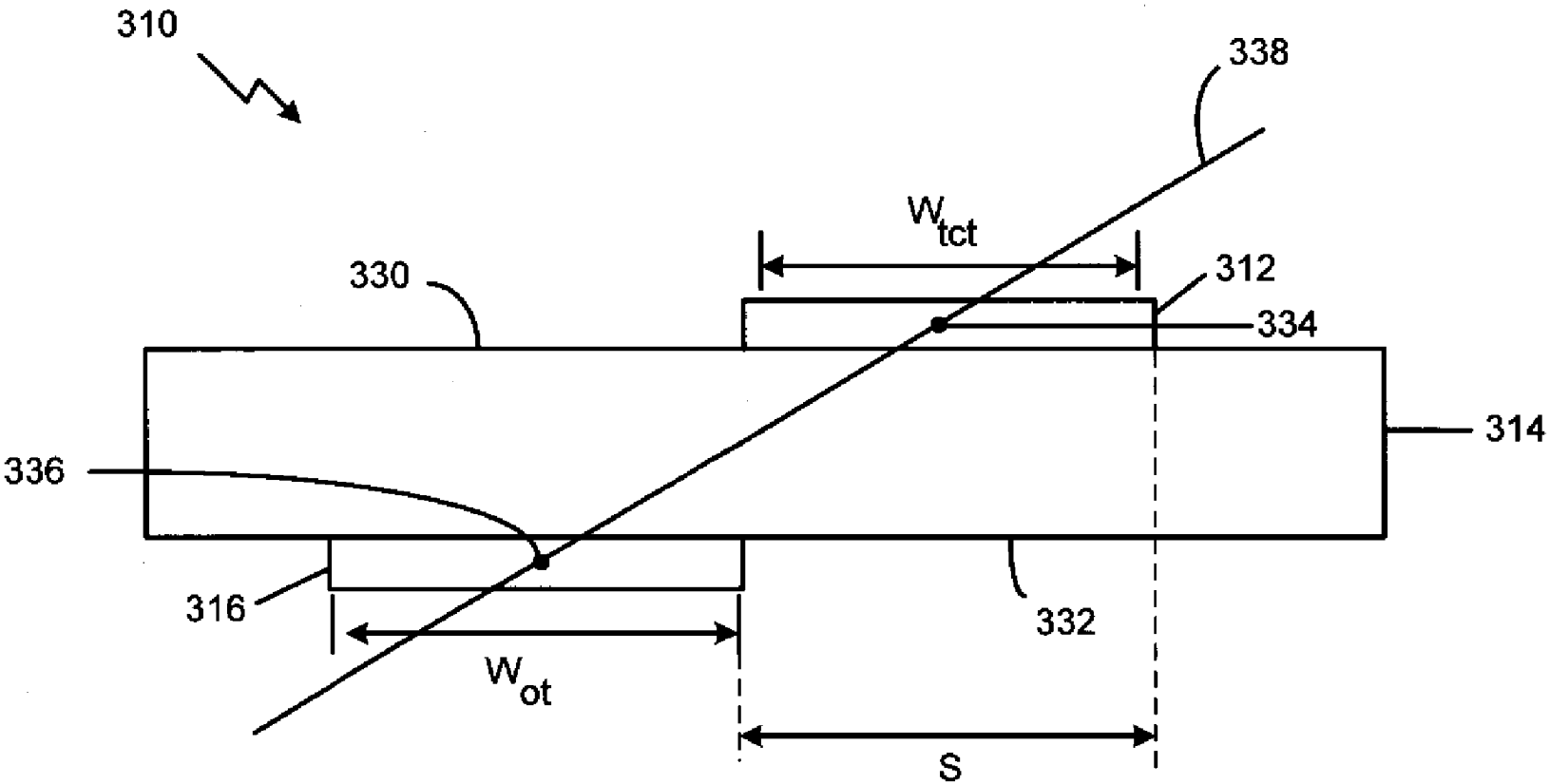
FIG. 7 is a cross-sectional diagram of a dipole antenna, in accordance with a second exemplary embodiment of the present invention.
Figure 8:
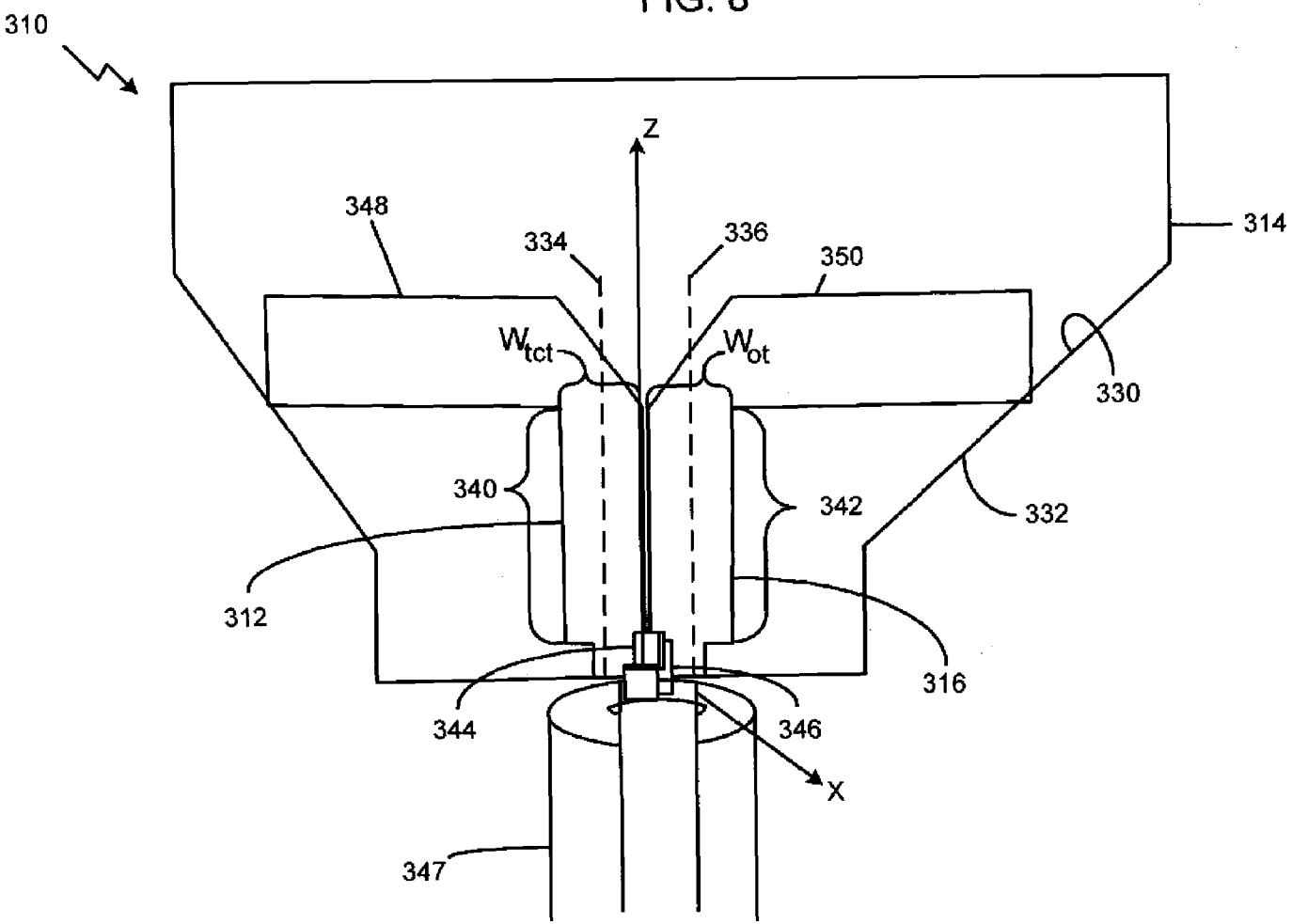
FIG. 8 is a perspective view of the dipole antenna of FIG. 7, in accordance with the second exemplary embodiment of the present invention.

FIG. 7 is a cross-sectional diagram of a dipole antenna 310, in accordance with a second exemplary embodiment of the present invention. FIG. 8 is a perspective view of the dipole antenna 310 of FIG. 7, in accordance with the second exemplary embodiment of the present invention. The dipole antenna 310 includes a dielectric substrate 314 having a first side 330 and an opposite side 332. A top conductor trace 312 is integral with the first side 330 of the dielectric substrate 314. The top conductor trace 312 has a top conductor axis 334, a top conductor length 340, and a top conductor width $W_{tct}$, wherein the top conductor width $W_{tct}$ is substantially uniform along the top conductor length 340. An opposite trace 316 is integral with the opposite side 332 of the dielectric substrate 314. The opposite trace 316 has an opposite length 342 and an opposite width $W_{ot}$ substantially congruent to the top conductor length 340 and the top conductor width $W_{tct}$. The opposite trace 316 also has an opposite axis 336 substantially parallel to the top conductor axis 334, wherein a plane containing both the top conductor axis 334 and the opposite axis 336 is oblique relative to the dielectric substrate 314.

The dipole antenna 310 also includes a top conductor feed 344 in electrical communication with the top conductor trace 312 and an opposite feed 346 in electrical communication with the opposite trace 316. The top conductor feed 344 and opposite feed 346 may be fed in turn through feed source 347. As shown, the top conductor width $W_{tct}$ is approximately between 0.5 mm and 5.0 mm and the top conductor length 340 is at least 7.0 mm.

In the second exemplary embodiment, the top conductor trace 312 and the opposite trace 316 do not overlap opposite sides of a same portion of the dielectric substrate 314. As can be deduced from the graph of FIG. 6 for the first exemplary embodiment, trace widths that are smaller than offset distance S will not overlap opposite sides of a same portion of the dielectric substrate 314. Trace widths that are larger than the offset distance S will overlap opposite sides of a same portion of the dielectric substrate 314. Further, the same portion of the dielectric substrate 314 has a width dimension of $W_{tct}$-S and an approximate equivalent length to top conductor length 340.

As shown in FIG. 8, the dipole antenna 310 will also include a top extending trace 348 extending from the top conductor trace 312 and an opposite extending trace 350 extending from the opposite trace 316, wherein the top extending trace 348 is positioned symmetrically opposite the opposite extending trace 350 relative to the plane. The top extending trace 348 and the opposite extending trace 350 may be constructed of any of a variety of shapes as is known to those having ordinary skill in the art and, in particular, the dipole design shown in FIG. 7 can be modified to provide any dipole design known to those having ordinary skill in the art without departing from the scope of the present invention.

Figure 9:
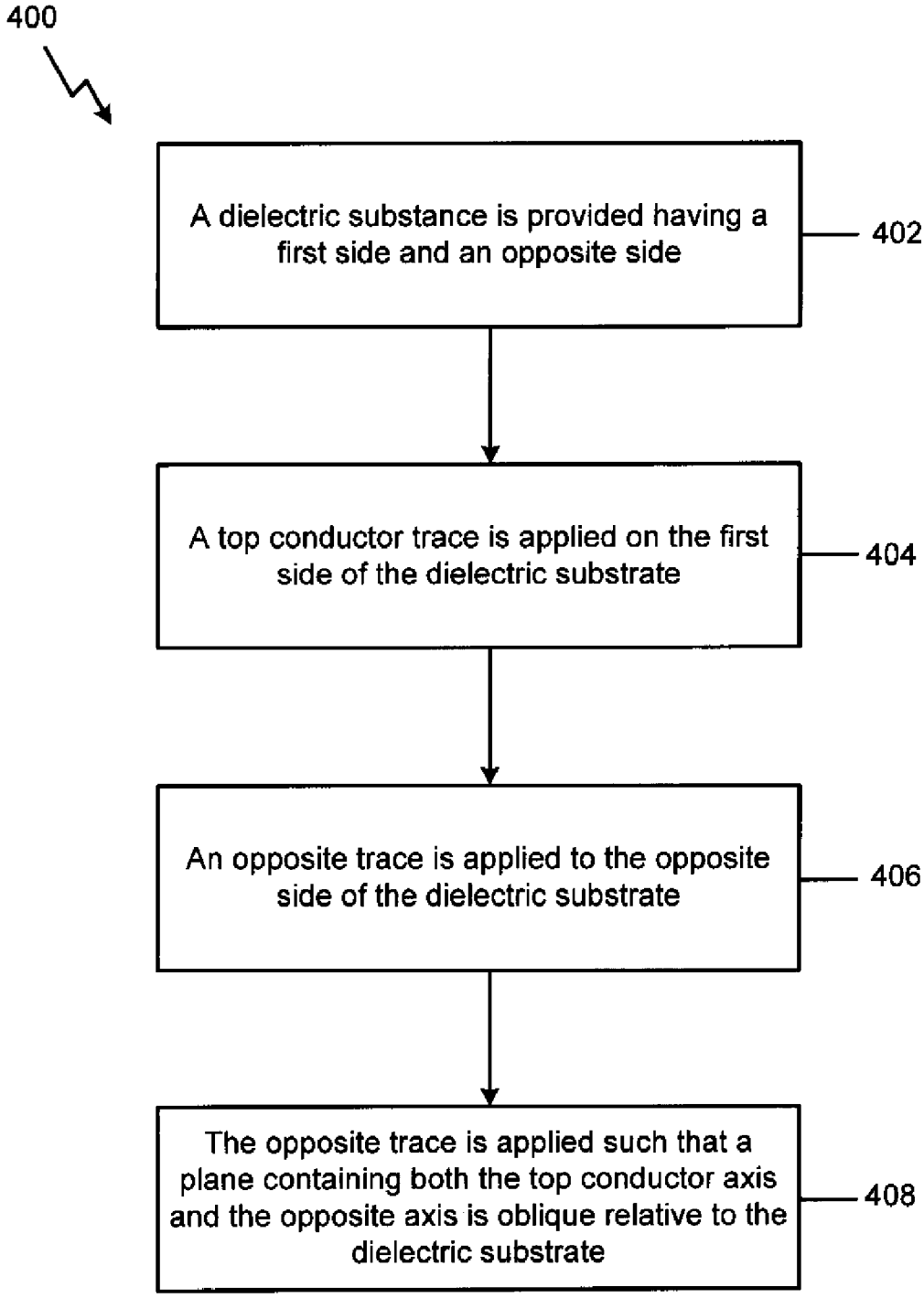
FIG. 9 is a flowchart illustrating a method of providing the above-mentioned quasi-twin lead line in accordance with the first exemplary embodiment of the invention.

FIG. 9 is a flowchart 400 illustrating a method of providing the above-mentioned quasi-twin lead line 210 in accordance with the first exemplary embodiment of the invention. It should be noted that any process descriptions or blocks in flow charts should be understood as representing modules, segments, portions of code, or steps that include one or more instructions for implementing specific logical functions in the process, and alternate implementations are included within the scope of the present invention in which functions may be executed out of order from that shown or discussed, including substantially concurrently or in reverse order, depending on the functionality involved, as would be understood by those reasonably skilled in the art of the present invention.

As is shown by block 402, a dielectric substance 214 is provided having a first side 230 and an opposite side 232. A top conductor trace 212 is applied on the first side 230 of the dielectric substrate 214 (block 404). The top conductor trace 212 has a top conductor axis 234, a top conductor length, and a top conductor width $W_{tct}$, wherein the top conductor width $W_{tct}$ is substantially uniform along the top conductor length. An opposite trace 216 is applied to the opposite side 232 of the dielectric substrate 214 (block 406). The opposite trace 216 has an opposite length and an opposite width $W_{ot}$ substantially congruent to the top conductor length and the top conductor width $W_{tct}$. The opposite trace 216 also has an opposite axis 236 substantially parallel to the top conductor axis 234. The opposite trace 216 is applied such that a plane 238 containing both the top conductor axis 234 and the opposite axis 236 is oblique relative to the dielectric substrate 214 (block 408).

One of the benefits of the method disclosed in FIG. 9 is the ability to provide a wide range of characteristic line impedances for quasi-twin lead antenna 210. As such, an additional step to the method may be setting an offset distance S of the opposite trace 216 relative to the top conductor trace 214 to achieve a desired characteristic line impedance.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. An antenna device comprising:

a dielectric substrate having a first side and an opposite side;

a top conductor trace on the first side of the dielectric substrate, the top conductor trace having a top conductor axis, a top conductor length, and a top conductor width, wherein the top conductor width is substantially uniform along the top conductor length; and an opposite trace on the opposite side of the dielectric substrate, the opposite trace having an opposite length and an opposite width substantially congruent to the top conductor length and the top conductor width, the opposite trace further having a opposite axis substantially parallel to the top conductor axis, wherein a plane containing both the top conductor axis and the opposite axis is oblique relative to the dielectric substrate.

2. The antenna device of claim 1, further comprising a top conductor feed in electrical communication with the top conductor trace; and an opposite feed in electrical communication with the opposite trace.

3. The antenna device of claim 1, wherein the top conductor width is approximately between 0.5 mm and 5.0 mm and the top conductor length is at least 7.0 mm.

4. The antenna device of claim 1, wherein the top conductor trace and the opposite trace overlap opposite sides of a same portion of the dielectric substrate.

5. The antenna device of claim 1, further comprising a top extending trace extending from the top conductor trace and an opposite extending trace extending from the opposite trace, wherein the top extending trace positioned symmetrically relative to the opposite extending trace about the plane.

6. The antenna device of claim 1, further comprising additional pairs of top conductor and opposite traces thereby increasing antenna gain.

7. The antenna device of claim 1 further comprising one of a parabolic reflector and a corner reflector thereby increasing antenna gain.

8. A method of assembling an antenna device, the method comprising the steps of:

providing a dielectric substance having a first side and an opposite side;

applying a top conductor trace on the first side of the dielectric substrate, the top conductor trace having a top conductor axis, a top conductor length, and a top conductor width, wherein the top conductor width is substantially uniform along the top conductor length; and applying an opposite trace on the opposite side of the dielectric substrate, the opposite trace having an opposite length and an opposite width substantially congruent to the top conductor length and the top conductor width, the opposite trace further having a opposite axis substantially parallel to the top conductor axis, wherein a plane containing both the top conductor axis and the opposite axis is oblique relative to the dielectric substrate.

9. The method of claim 8, further comprising setting an offset distance of the opposite trace relative to the top conductor trace to achieve a desired characteristic line impedance.

10. The method of claim 8, further comprising filtering a signal utilizing the top conductor trace and the opposite trace.

11. The method of claim 8, further comprising connecting a top conductor feed to the top conductor trace; and connecting an opposite feed to the opposite trace.

* * * * *